US005659917A

United States Patent [19]

Kotary

[11] Patent Number: 5,659,917

[45] Date of Patent: Aug. 26, 1997

[54] CHIMNEY CLEANER ASSEMBLY

[76] Inventor: David E. Kotary, 6461 Williams Rd., Rome, N.Y. 13440

[21] Appl. No.: 687,685

[22] Filed: Jul. 26, 1996

[51] Int. Cl.[6] ..... F23J 3/00

[52] U.S. Cl. ..... 15/249.3; 15/104.069

[58] Field of Search ..... 15/104.066, 104.067, 15/104.068, 104.069, 249.1, 249.2, 249.3

[56] References Cited

U.S. PATENT DOCUMENTS

| | | | |
|---|---|---|---|
| 82,136 | 9/1868 | Luce | 15/249.3 X |
| 854,101 | 5/1907 | Miller | 15/249.3 X |
| 1,184,784 | 5/1916 | Steiner | 15/249.3 |
| 1,315,849 | 9/1919 | MacDonald | 15/104.069 |
| 1,329,596 | 2/1920 | Harbort | 15/249.3 X |
| 1,516,949 | 11/1924 | Bergerson | 15/249.2 |
| 1,663,604 | 3/1928 | Moen | 15/104.069 |
| 1,770,338 | 7/1930 | Kohl | 15/104.069 |
| 2,602,177 | 7/1952 | Aho | 15/104.067 |
| 4,028,769 | 6/1977 | Coviello et al. . | |
| 4,085,477 | 4/1978 | Anderson | 15/104.069 |
| 4,319,378 | 3/1982 | Bowman et al. . | |
| 4,353,143 | 10/1982 | Beaudoin et al. . | |
| 4,409,703 | 10/1983 | Marcellus . | |
| 4,454,625 | 6/1984 | Kern . | |
| 4,505,000 | 3/1985 | Boehland et al. . | |
| 4,512,055 | 4/1985 | Boehland et al. . | |
| 4,538,317 | 9/1985 | Sorensen . | |
| 4,619,011 | 10/1986 | Grooms . | |
| 4,638,524 | 1/1987 | Marcellus . | |
| 4,757,573 | 7/1988 | Brophy | 15/104.069 |
| 4,949,418 | 8/1990 | Girard et al. . | |

FOREIGN PATENT DOCUMENTS

| | | | |
|---|---|---|---|
| 19952 | 6/1944 | Finland | 15/104.069 |
| 340973 | 7/1904 | France | 15/249.1 |
| 953907 | 12/1949 | France | 15/104.067 |
| 1121999 | 8/1956 | France | 15/104.067 |
| 1130578 | 5/1962 | Germany | 15/104.069 |

*Primary Examiner*—Mark Spisich
*Attorney, Agent, or Firm*—Harris Beach & Wilcox, LLP

[57] ABSTRACT

A chimney cleaning apparatus for cleaning the walls of the chimney comprising a support member selectively placed in the chimney having a top mounting bracket and a bottom mounting bracket. The support member has a clevis arm pivotally attached at one end to the support member. The clevis arm has a cutting blade mounted at the other end which is in contact with the wall of the chimney. There is a first spring connecting the clevis arm to the top mounting bracket and a second spring connecting the clevis arm to the bottom mounting bracket, such that the first spring and the second spring bias the clevis arm in a substantially horizontal position and such that the cutting blade is biased to contact the chimney wall when the support member is moved upwardly or downwardly in the chimney.

2 Claims, 3 Drawing Sheets

CHIMNEY CLEANER ASSEMBLY

FIELD OF THE INVENTION

This invention relates generally to an apparatus for cleaning a chimney flue, and more specifically to a chimney cleaning blade assembly for use with an automatic chimney cleaner.

BACKGROUND OF THE INVENTION

There are a large number of homes and small business establishments in which one or more fireplaces or wood burning stoves exhaust through a chimney flue. After a certain amount of use, the flue inside the chimney can become clogged with accumulated ashes and creosote. Such a clogged chimney is unsafe in that it may result in fire or in improper venting which can lead to accumulation of carbon monoxide and other gases inside the home. Therefore, when soot and creosote begin to accumulate to high levels or when clogging occurs it is imperative that the flue be cleaned.

Numerous devices have been used to clean flues that have buildups of creosote and soot. The majority of these devices include either brushes or cutter bars that are drawn or propelled through the flue. The creosote buildups are often irregular in configuration and often times the cleaning apparatus becomes stuck, requiring additional labor to free the apparatus from the flue.

In addition to the difficulties experienced in freeing the apparatus from the flue, it is dangerous for a typical homeowner to climb onto the roof of the structure in an attempt to free any cleaning devices because of the likelihood of a fall from the roof. The instant invention is directed to a chimney cleaning apparatus that needs to be installed on the roof for the initial use, but thereafter can be manipulated by a householder or other user from the ground outside the house. The invention provides a simple apparatus that is easily installed and easily used and that can be customized in shape and size to accommodate any flue interior.

SUMMARY OF THE INVENTION

It is object of the present invention to provide an improved apparatus for cleaning a chimney flue.

It is another object of the present invention to provide an improved chimney cleaning apparatus for use with an automatic chimney cleaning system.

It is yet another object of the present invention to provide an apparatus for cleaning a chimney flue that can be operated safely from the ground outside a structure.

It is another object of the present invention to provide an apparatus and method for cleaning a chimney flue that is simple for a householder to operate.

It is yet a further object of the present invention to provide an apparatus for cleaning a chimney flue that can remain in place once installed in a chimney.

These and other objects are achieved by a chimney cleaning apparatus for cleaning the walls of the chimney comprising a support member selectively placed in the chimney having a top mounting bracket and a bottom mounting bracket. The support member has a clevis arm pivotally attached at one end to the support member. The clevis arm has a cutting blade mounted at the other end which is in contact with the wall of the chimney. There is a first spring connecting the clevis arm to the top mounting bracket and a second spring connecting the clevis arm to the bottom mounting bracket, such that the first spring and the second spring bias the clevis arm in a substantially horizontal position and such that the cutting blade is biased to contact the chimney wall when the support member is moved upwardly or downwardly in the chimney.

BRIEF DESCRIPTION OF THE DRAWING

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
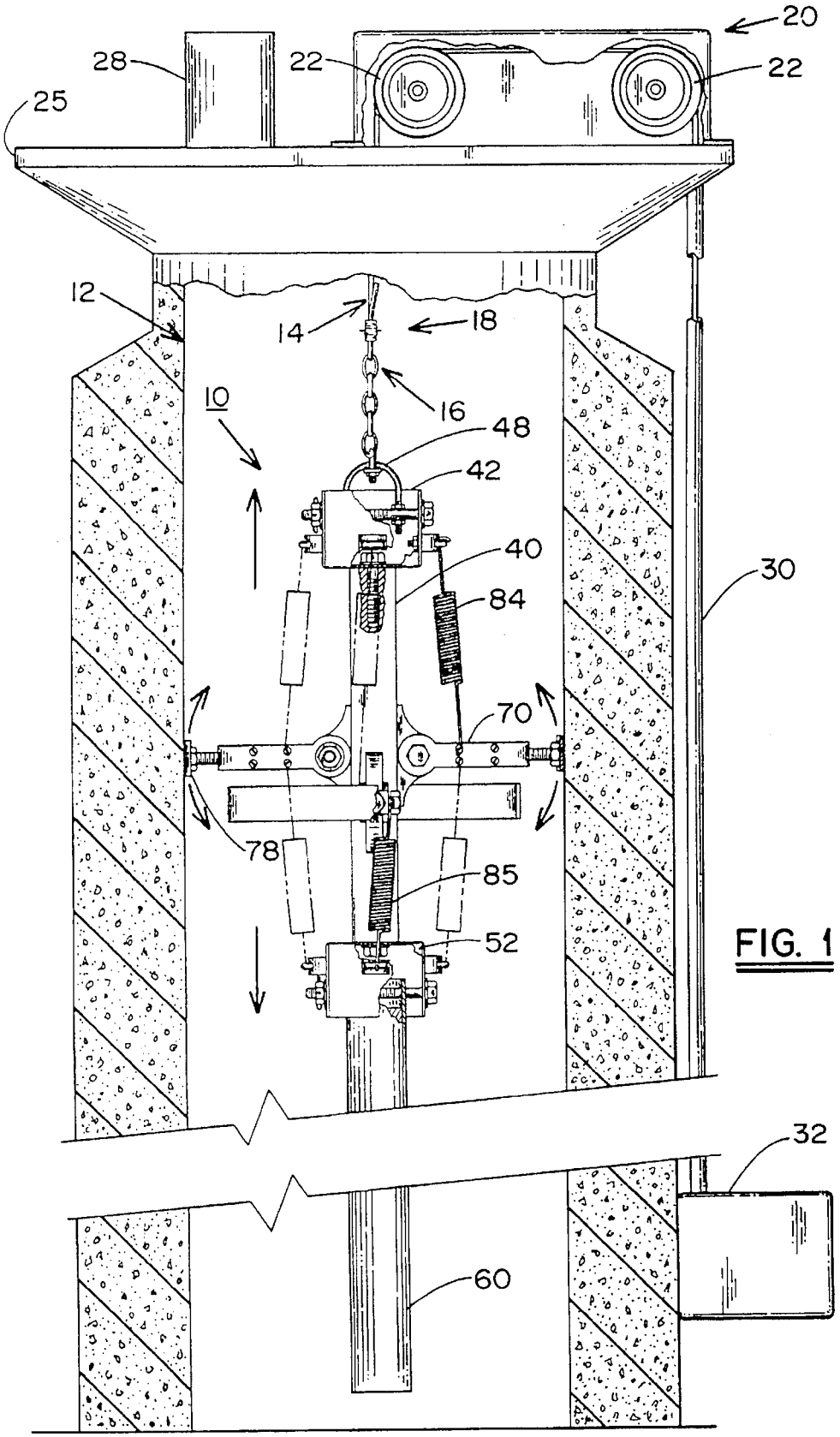
FIG. 1 is a cut-away perspective view of a chimney fitted with a flue-cleaning apparatus in accordance with the invention.

Referring now to FIG. 1, there is shown a chimney cleaning apparatus that embodies the present invention. The chimney cleaner assembly 10, explained in greater detail below, is placed within the chimney flue 12. The cleaner assembly 10 is attached to a cable 14 which is made of a fireproof material, preferably steel. The cleaner assembly 10 is attached to the cable 14 by a steel chain 16. The steel chain 16 and the cable 14 are attached by a coupler 18. One skilled in the art would recognize that there are a number of types of couplers that could be employed to attach the steel chain 16 to the cable 14. The cable 14 is threaded through a pulley system 20 which consists of two pulleys 22—22 rotatably mounted on the top side of a chimney cap 25. The pulley system 20 is arranged such that the chimney cleaner assembly 10 can be moved up and down in the flue by the operator from a position on the outside, preferably near the ground, so that the operator will have easy access to the chimney cleaning apparatus.

The chimney cap 25 is constructed of steel or a similar heat resistant material. The chimney cap 25 is secured to the top of the chimney, preferably by attaching four angle irons (not shown) in a vertical position to the interior of the top of the flue 12, one angle iron on each of the four sides of the flue 12. The chimney cap 25 rests on and is fastened to the top of the angle irons. This method of mounting the cap 25 provides for a substantially free passage through the central axis of the top of the chimney which allows for smoke to pass through the interior of the chimney cap 25 to a smoke pipe 28 integral to the cap 25. The free passage area also allows for the steel cable 14 from which the cutter 10 depends to pass from the interior of the flue 12 to the pulley system 20. The pulley system 20 is mounted to the chimney cap 25 and in the preferred embodiment contains two pulleys 22—22 placed in an arrangement to direct the steel cable 14 from the interior of the flue 12 to a plastic pipe 30 placed in a vertical orientation on the outside of the chimney. The plastic pipe 30 acts as a conduit to the motor/control box 32 which is mounted at a position on the exterior of the chimney. The position of the motor/control box 32 is one that would be convenient to the homeowner/operator. The plastic pipe 30 encloses and serves to protect the steel cable 14 from any harmful environmental conditions. As would be well known to one skilled in the art, the motor/control box 32 contains a motor that acts on the cable 14 to cause the cutter to move upwardly and downwardly in the flue 12 and can be used in a manual or automatic mode.

Figure 2:
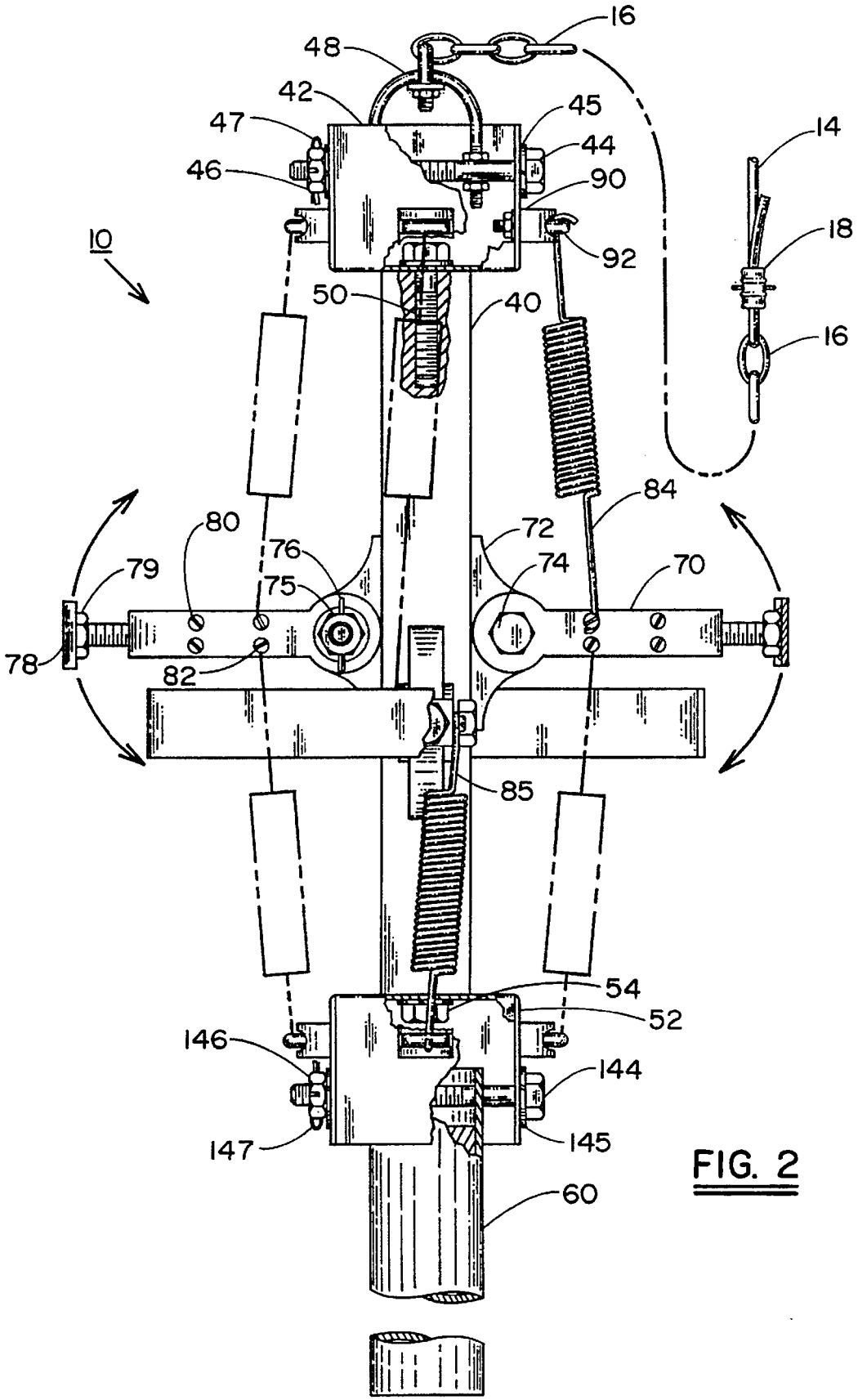
FIG. 2 is a plan view of a chimney cleaning apparatus embodying the claimed invention.
Figure 3:
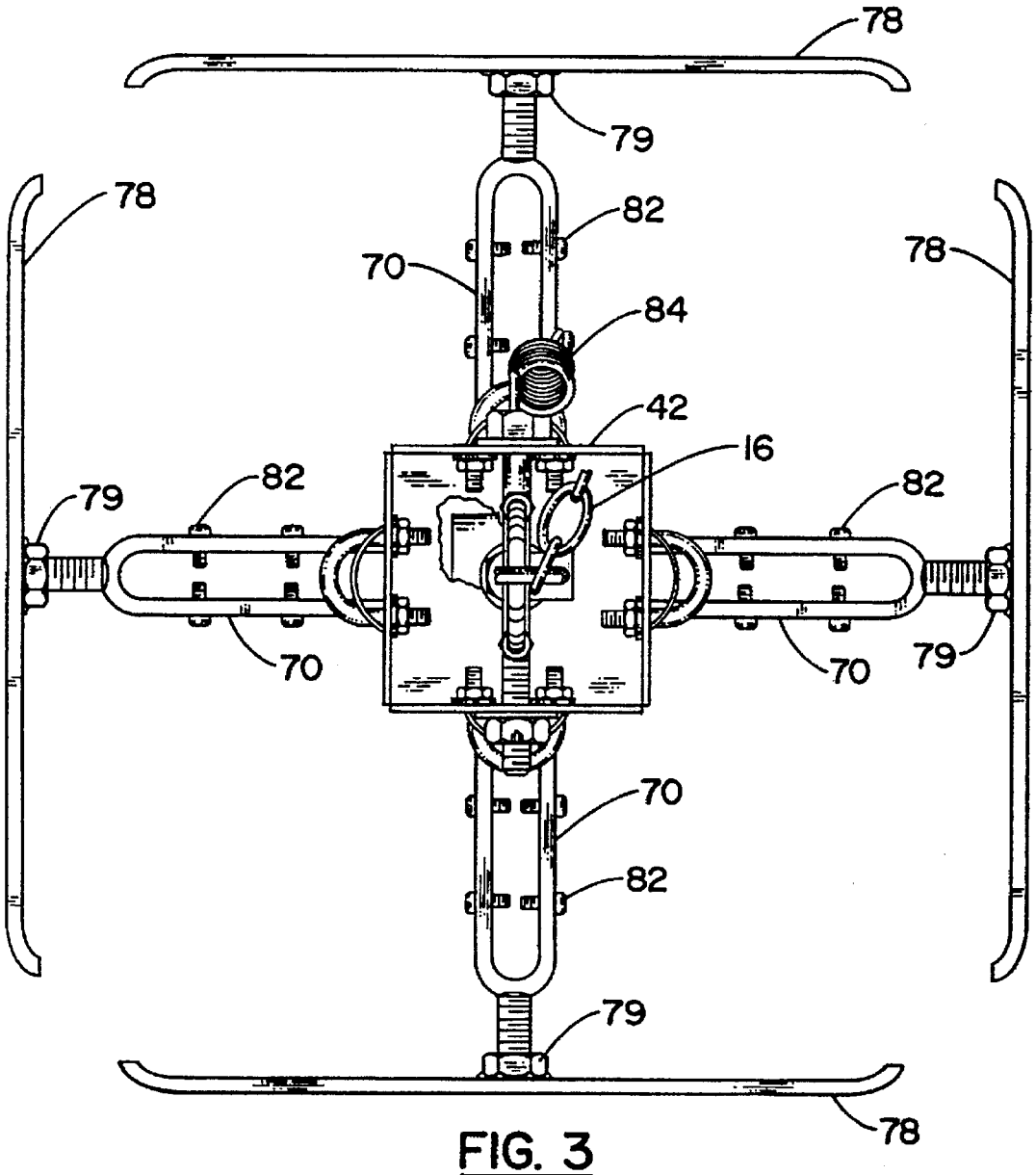
FIG. 3 is a top plan view of a chimney cleaning apparatus embodying the claimed invention.

Referring now to FIGS. 1, 2 and 3, there is shown the cleaner assembly 10. The assembly has a steel bar 40 that is connected to the steel chain 16 by a first mounting bracket 42 that is located near the top of the steel bar 40. A locking bolt 44 is passes through a steel washer 45, the first mounting bracket 42 and a nut 46. The locking bolt 44 is locked in place by use of a cotter pin 47. A U-bolt 48 is used to connect the locking bolt 44 to the steel chain 16. The first mounting bracket 42 is attached to the steel bar 40 by a bolt 50 which is sunk into the top of the steel bar 40.

The steel bar 40 has a second mounting bracket 52 located at or near the bottom of the steel bar 40 which is attached thereto by use of a bolt 54 which is sunk into the bottom of the steel bar 40. The second mounting bracket 52 has a counterweight 60 attached thereto. The counterweight 60 in the preferred embodiment is a lead filled steel pipe. The counterweight 60 is attached to the second mounting bracket 52 by a locking bolt 144 that passes through a steel washer 145, the second mounting bracket 52 and a nut 146. The nut 146 is held in place by a cotter pin 147.

The steel bar 40 has four D-shaped brackets 72 connected at or near the midpoint of the steel bar 40. Each bracket 72 has a clevis arm 70 attached thereto by a bolt 74 secured by a nut 75 and cotter pin 76. The clevis arm 70 is mounted such that it may pivot in the vertical plane with the pivot point located at the D-shaped bracket 72. Attached to the end of each clevis arm 70 is a steel cutting blade 78. In the preferred embodiment, the end of the clevis arm 70 is provided with a threaded end onto which the cutting blade 78 is attached thereto and secured in place by a locking nut 79.

The clevis arm has holes 80 that are machined in the lateral surfaces that accept machine screws 82. The machine screws 82 secure to the clevis arm 70 one end of a top spring 84 and one end of a bottom spring 85. The top spring 84 is attached at its other end to the top mounting bracket 42 and the bottom spring 85 is attached at its other end to the bottom mounting bracket 52. The respective springs are attached to the respective mounting brackets by clamps 90 which includes a U-bolt/nut assembly 92. The springs serve to bias the clevis arm in the horizontal plane. The force supplied by the biasing action of the springs that is exerted on the clevis arms causes the cutting bar to break through creosote buildups on the chimney walls.

In the preferred embodiment in which the chimney cleaning assembly 10 will be used in a typical four-sided chimney, the present invention utilizes four clevis arms With a cutter blade on each arm. Using this configuration, the present invention cleans each of the interior walls by providing a cutter blade for each side of the interior of the chimney. One skilled in the art would recognize that different chimney configurations could be cleaned by altering the number of clevis arm/cutter blades on the clearing assembly.

In use, the operator stands on the exterior of the chimney, preferably on the ground, and actuates the motor assembly. The motor drives the cable which moves the cleaning assembly in the upward direction. When the cleaning assembly has moved a predetermined distance upward through the chimney to a point at or near the top of the flue, the motor is disengaged. The cleaning assembly, with the added weight supplied by the counterweight, falls a predetermined distance to a point at or near the bottom of the chimney. The clearing assembly easily moves through the flue and is able to cut through heavy creosote buildup.

While the present invention has been particularly shown and described with reference to the preferred mode as illustrated in the drawing, it will be understood by one skilled in the art that various changes in detail may be effected therein without departing from the spirit arid scope of the invention as defined by the claims.

We claim:

1. A chimney cleaning apparatus for cleaning the walls of the chimney comprising:

a support member selectively placed in the chimney, said support member having a top mounting bracket and a bottom mounting bracket;

a clevis arm pivotally attached at one end to said support member, said clevis arm having a cutting blade mounted at the other end of said clevis arm, said cutting blade in contact with the wall of the chimney;

a first biasing means connecting said clevis arm to said top mounting bracket; and, a second biasing means connecting said clevis arm to said bottom mounting bracket, such that said first biasing means and said second biasing means bias the clevis arm in a substantially horizontal position and such that said cutting blade is biased to contact the chimney wall when said support member is moved upwardly or downwardly in the chimney.

2. A chimney cleaning apparatus for cleaning the walls of the chimney comprising:

a support member selectively placed in the chimney, said support member having a top mounting bracket and a bottom mounting bracket;

a clevis arm pivotally attached at one end to said support member, said clevis arm having a cutting blade mounted at the other end of said clevis arm, said cutting blade in contact with the wall of the chimney;

a first biasing means connecting said clevis arm to said top mounting bracket;

a second biasing means connecting said clevis arm to said bottom mounting bracket, such that said first biasing means and said biasing means bias the clevis arm in a substantially horizontal position and such that said cutting blade is biased to contact the chimney wall when said support member is moved upwardly or downwardly in the chimney;

a cable positioned such that said cable extends from the interior of the chimney to a position on the exterior of the chimney;

connecting means to secure said support member to said cable; and, a chimney cap secured to the chimney, said chimney cap having a pulley system contained therein, wherein said pulley system engages said cable.

* * * * *